US011555326B2

(12) United States Patent
McGlynn et al.

(10) Patent No.: US 11,555,326 B2
(45) Date of Patent: Jan. 17, 2023

(54) INFLATABLE IMPACT SHIELD SYSTEM

(71) Applicant: Rowan University, Glassboro, NJ (US)

(72) Inventors: Charles D. McGlynn, Williamstown, NJ (US); Cheng Zhu, Cherry Hill, NJ (US)

(73) Assignee: Rowan University, Glassboro, NJ (US)

( * ) Notice: Subject to any disclaimer, the term of this patent is extended or adjusted under 35 U.S.C. 154(b) by 167 days.

(21) Appl. No.: 16/762,037

(22) PCT Filed: Jan. 4, 2019

(86) PCT No.: PCT/US2019/012331
§ 371 (c)(1),
(2) Date: May 6, 2020

(87) PCT Pub. No.: WO2019/136235
PCT Pub. Date: Jul. 11, 2019

(65) Prior Publication Data
US 2020/0340268 A1 Oct. 29, 2020

Related U.S. Application Data

(60) Provisional application No. 62/613,925, filed on Jan. 5, 2018.

(51) Int. Cl.
*E04H 9/02* (2006.01)
*E04H 15/20* (2006.01)
(Continued)

(52) U.S. Cl.
CPC ..... *E04H 15/20* (2013.01); *E04H 9/028* (2013.01); *E04H 9/029* (2013.01); *E04H 9/10* (2013.01);
(Continued)

(58) Field of Classification Search
CPC ..... E04H 15/20; E04H 9/028; E04H 9/029; E04H 9/10; E04H 9/14; E04H 9/16;
(Continued)

(56) References Cited

U.S. PATENT DOCUMENTS 2,812,769 A * 11/1957 Schaefer ..... E04H 15/20 52/2.21
2,908,919 A * 10/1959 Bicknell ..... E04H 15/20 52/2.21
(Continued)

FOREIGN PATENT DOCUMENTS

AT 516623 B1 * 7/2016
CN 100400788 C * 7/2008
(Continued)

OTHER PUBLICATIONS

International Search Report and Written Opinion, International Patent Application No. PCT/US2019/012331, dated Jan. 4, 2019, Apr. 1, 2019.

*Primary Examiner* — Robert Canfield
(74) *Attorney, Agent, or Firm* — Saul Ewing LLP; Domingos J. Silva; Brandon Newton

(57) ABSTRACT

An impact shield for earthquake protection is described herein. The impact shield may include a canopy constructed of a puncture-resistant material, the canopy defining a first internal volume accessible via a first opening, the canopy being structured to form a semispherical shape when in an inflated state, the semispherical shape defining a space dimensioned for sheltering at least one human body; a support joined to the canopy and constructed of the puncture-resistant material, the support defining a second internal volume accessible via the first opening and a second opening, the support located within the space, the support structured to form a column when in the inflated state; and a fitting joined to the support for closing the second opening
(Continued)

to fix the first internal volume and the second internal volume after inflation of the support and the canopy.

10 Claims, 5 Drawing Sheets

(51) Int. Cl.

| | |
|---|---|
| ***E04H 15/26*** | (2006.01) |
| ***E04H 15/36*** | (2006.01) |
| ***E04H 9/16*** | (2006.01) |
| ***E04H 9/10*** | (2006.01) |
| ***E04H 9/14*** | (2006.01) |
| ***F41H 5/24*** | (2006.01) |
| ***F41H 5/08*** | (2006.01) |

(52) U.S. Cl.
CPC ..... *E04H 9/14* (2013.01); *E04H 9/16* (2013.01); *E04H 15/26* (2013.01); *E04H 15/36* (2013.01); *F41H 5/08* (2013.01); *F41H 5/24* (2013.01); *E04H 2015/201* (2013.01); *E04H 2015/202* (2013.01); *E04H 2015/204* (2013.01); *E04H 2015/206* (2013.01)

(58) Field of Classification Search
CPC ..... E04H 2015/201; E04H 2015/202; E04H 2015/204; E04H 2015/206
USPC ..... 52/2.17, 2.18, 2.22, 2.23
See application file for complete search history.

(56) References Cited

U.S. PATENT DOCUMENTS 2,934,075 A * 4/1960 Richardson ..... E04H 15/20 52/27
3,728,831 A * 4/1973 Bird ..... E04H 15/22 52/2.25
3,839,832 A * 10/1974 Kastner ..... E04H 15/22 52/2.14
3,857,209 A * 12/1974 Milliken ..... E04H 15/22 52/2.25
3,877,084 A * 4/1975 Johnson ..... A61H 33/06 4/526
4,876,829 A * 10/1989 Mattick ..... E04H 15/20 135/125
4,901,481 A 2/1990 Seeley
5,007,212 A * 4/1991 Fritts ..... E04H 15/20 52/2.18
5,575,024 A 11/1996 You
5,630,296 A * 5/1997 Kendall, Jr. ..... A62B 17/00 135/97
5,699,818 A 12/1997 Carpenter
5,893,238 A * 4/1999 Peacock ..... E04H 15/20 135/125
5,987,822 A * 11/1999 McNiff ..... E04H 15/20 52/2.13
6,061,969 A * 5/2000 Leary ..... E04H 15/20 52/2.18
6,065,252 A * 5/2000 Norsen ..... E06B 3/80 52/6
6,192,633 B1 * 2/2001 Hilbert ..... E04H 15/20 52/87
6,282,843 B1 * 9/2001 Shibaike ..... E04H 15/20 52/88
6,332,290 B1 * 12/2001 Delamare ..... E04H 15/20 52/2.13
6,453,619 B1 * 9/2002 Delamare ..... E04H 15/20 52/2.13
6,490,830 B2 12/2002 Ruan
6,685,520 B1 2/2004 Wiggins
7,552,555 B2 * 6/2009 Pellecuer ..... G09F 15/0025 40/745
7,721,749 B2 * 5/2010 Brewin ..... E04H 15/20 52/80.1
8,001,985 B1 8/2011 Conner
8,079,182 B1 * 12/2011 Higgins ..... E04H 7/24 52/2.25
8,752,336 B1 6/2014 Ozsuer
8,789,315 B2 * 7/2014 Han ..... A62B 13/00 52/2.13
10,179,998 B1 * 1/2019 Ramp ..... E04H 15/20
10,415,265 B1 * 9/2019 Liang ..... E04H 9/029
10,739,113 B1 * 8/2020 Bosen ..... F41H 11/00
10,801,231 B1 * 10/2020 Ensign ..... E04H 15/12
2002/0148176 A1 * 10/2002 Shelton ..... E04H 9/14 52/745.19
2002/0184837 A1 * 12/2002 Shelton ..... E04H 9/14 52/294
2003/0019515 A1 * 1/2003 Fritzche ..... E04H 15/20 52/2.13
2008/0257137 A1 * 10/2008 James ..... F42D 5/045 102/303
2008/0313969 A1 * 12/2008 Colucci ..... G03B 21/585 52/2.18
2009/0217930 A1 * 9/2009 Holley ..... A61G 10/026 52/80.1
2011/0107681 A1 * 5/2011 Zhang ..... E21F 11/00 52/2.17
2012/0131857 A1 * 5/2012 Ross-da Silva ..... E04H 15/20 52/2.18
2012/0144756 A1 * 6/2012 Meager ..... A62C 2/10 52/2.22
2013/0068851 A1 * 3/2013 Young ..... A61M 35/25 52/2.13
2015/0225976 A1 8/2015 Carlson et al.
2015/0336644 A1 11/2015 Cho
2016/0130831 A1 5/2016 Zhou
2021/0254363 A1 * 8/2021 Laetsch ..... E04H 15/18

FOREIGN PATENT DOCUMENTS

CN 111379321 A * 7/2020
CN 111835268 A * 10/2020
CN 113216732 A * 8/2021
DE 202015006965 U1 * 11/2015 ..... E04H 15/20
EP 345600 A * 12/1989 ..... E04H 1/1277
GB 2104934 A * 3/1983 ..... E04H 15/20
GB 2368599 A * 5/2002 ..... E04H 15/20
KR 100754848 B1 * 9/2007 ..... E04H 15/20
KR 20140112763 A * 9/2014 ..... E04H 15/22
WO WO-2005017291 A1 * 2/2005 ..... E04H 15/20
WO WO-2014179865 A1 * 11/2014 ..... E04H 15/20
WO 2015118458 A1 8/2015
WO 2015151083 A1 10/2015
WO 2016204313 A1 12/2016
WO WO-2018147750 A1 * 8/2018

* cited by examiner

INFLATABLE IMPACT SHIELD SYSTEM

CROSS-REFERENCE TO RELATED APPLICATION(S)

This application is a national phase application under 35 U.S.C. 371 of International Application No. PCT/US2019/012331, filed Jan. 4, 2019, which claims the benefit of priority of U.S. Provisional Patent Application Ser. No. 62/613,925, filed Jan. 5, 2018. The entire content of each application is hereby incorporated by reference herein.

BACKGROUND OF THE INVENTION

There are more than 500,000 earthquakes annually throughout the world. Most of these earthquakes are low magnitude earthquakes with little to no impact on building structures or people. Approximately 3,000 earthquakes are perceptible by humans annually with approximately 4.7 million people impacted each year from these earthquakes. In 2015, there were over 1,500 earthquakes with a magnitude of 5.0 or greater on the Richter scale, resulting in almost 10,000 deaths.

On average, there are seven to eleven earthquakes annually that result in significant loss of life. Also, there are approximately 20 earthquakes a year that result in more than ten deaths, more than 100 people affected, a request for international assistance, or a declaration of a state of emergency. In addition to the loss of life and injuries that can occur, the economic impact of earthquakes can be devastating. Earthquakes in the United States alone are estimated to result in building damages of over $6 billion annually.

Populations continue to increase in areas that have high level of seismic activity, especially in urban communities along the western United States, Japan, China, South America, and India. By 2030, approximately 60 percent of the global population or approximately 5 billion people are expected to live in urban areas. Building construction and the propensity for buildings to collapse significantly contribute to mortality during earthquakes. For example, in the 1976 Guatemalan earthquake that resulted in approximately 23,000 deaths and over 75,000 injuries, all deaths and serious injuries occurred during the collapse of heavy adobe brick structures.

SUMMARY OF THE INVENTION

An impact shield system for mitigating the injuries of individuals during natural disasters is described. The impact shield may be a portable, inexpensive seismic hazard and kinetic energy risk reduction system. The impact shield system may be designed to protect individuals from being injured or killed by structural failure or falling debris due to seismic events. Prior to inflation, the impact shield system may include compact dimensions which may allow for compact storage (e.g., dimensions of approximately 40 in.×20 in.×12 in.). The impact shield system may also be stored and inflated quickly in an emergency situation, and therefore may be well-suited for widespread distribution in areas of high seismic activity or risk of seismic activity.

The impact shield system may be constructed in such a way to maximize the rigidity and potential load bearing of the system. The impact shield system may include a canopy constructed of durable, puncture-resistant laminated fabric, such as chlorosulfonated polyethylene. The canopy may be designed to be semispherical in shape, or may alternatively be designed in another shape so as to allow an individual to be enveloped by the impact shield. Additionally, the impact shield system may include a central column attached to the canopy to provide a vertical support beam underneath the canopy. In some cases, the impact shield system may be constructed of individual spar segments that impart enhanced structural rigidity after inflation. Additionally, the spars may include straps that may be inflated via a separate channel, and that provide additional directional support to direct forces down and away from the canopy top.

An impact shield for earthquake protection is described herein. The impact shield may include a canopy constructed of a puncture-resistant material, the canopy defining a first internal volume accessible via a first opening, the canopy being structured to form a semispherical shape when in an inflated state, the semispherical shape defining a space dimensioned for sheltering at least one human body; a support joined to the canopy and constructed of the puncture-resistant material, the support defining a second internal volume accessible via the first opening and a second opening, the support located within the space, the support structured to form a column when in the inflated state; and a fitting joined to the support for closing the second opening to fix the first internal volume and the second internal volume after inflation of the support and the canopy.

Some examples of the impact shield may provide for the canopy further including a plurality of individual spars. Some examples of the impact shield may provide for at least one of the plurality of individual spars extends perpendicular to at least a second of the plurality of individual spars. Some examples of the impact shield may further provide at least one of the plurality of individual spars extends parallel to at least a second of the plurality of individual spars.

Some examples of the impact shield may provide for the plurality of individual spars to be connected in a series configuration, in a parallel configuration, or a combination thereof. Some examples of the impact shield may further provide for the series configuration, the parallel configuration, or the combination thereof, to prevent a deflation of the canopy when at least one of the plurality of individual spars is punctured. Some examples of the impact shield may further provide for the support to further include at least one individual spar.

Some examples of the impact shield may further provide for an inflation mechanism (e.g., 145, 245) joined to the fitting (e.g., 140, 240), the inflation mechanism configured to, when activated, direct a flow of gas into the support to cause the support and the canopy to assume the inflated state.

Some examples of the impact shield may further include a seismic detection device (e.g., 155, 255) configured to: identify a seismic event and activate the inflation mechanism when the seismic event is identified. Some examples of the impact shield may further provide for the seismic detection device to include a smartphone.

Some examples of the impact shield may further include a mat or bed (e.g., 150, 250), the mat or bed attachable to a bottom portion (e.g. 105) of the canopy.

BRIEF DESCRIPTION OF THE DRAWINGS

For a fuller understanding of the nature and desired objects of the present invention, reference is made to the following detailed description taken in conjunction with the accompanying drawing figures wherein like reference characters denote corresponding parts throughout the several views.

DEFINITIONS

The instant invention is most clearly understood with reference to the following definitions.

As used herein, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Unless specifically stated or obvious from context, the term "or," as used herein, is understood to be inclusive.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

DETAILED DESCRIPTION OF THE INVENTION

Impact Mitigation

Conventional impact mitigation technology does not provide for a lightweight, portable, and effective system that can safely protect an individual from harm in the event of an earthquake. Some conventional systems must be affixed to a specific location, such as a room or a bed. Other systems are so heavy that they are practically affixed to a given location. Yet other systems do not provide for sufficient protection from earthquake damage, either because the system does not fully cover an individual, or because the rigidity of the system itself is unreliable. Additionally, conventional systems currently marketed for use are cost-prohibitive (e.g., in the range of thousands to tens of thousands of dollars) which thereby decreases the practical availability of these conventional systems, particularly in poorer, less-developed countries.

Impact Shield for Earthquake Protection

Figure 1:
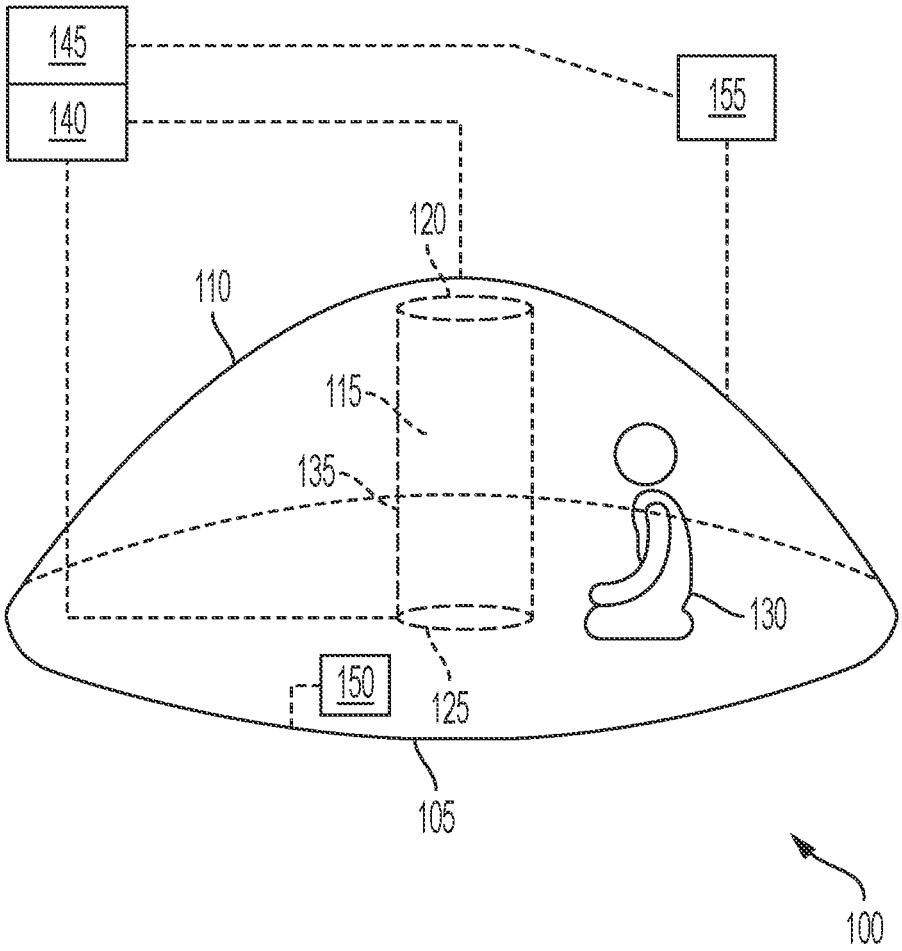
FIG. 1 illustrates an impact shield system according to one or more embodiments of the present disclosure.

Aspects of the invention provide for systems for the protection of individuals during an earthquake or building collapse. In one aspect, the invention provides an impact shield 100 as depicted in FIG. 1. The impact shield 100 is an inflatable system designed to protect individuals from falling objects in the event of an earthquake or other disaster.

Figure 3:
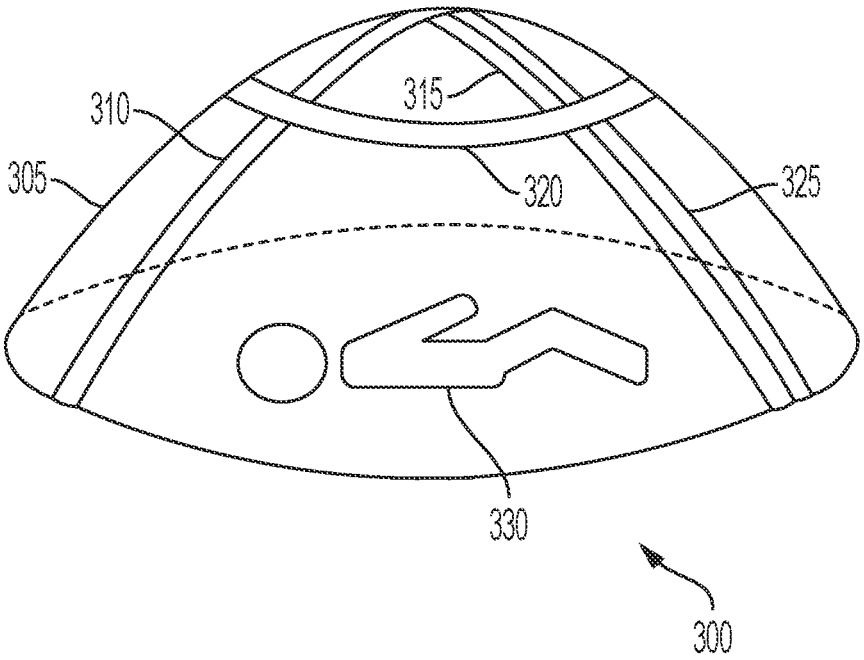
FIG. 3 illustrates an impact shield system with spar segments, according to one or more embodiments of the present disclosure.
Figure 5A:
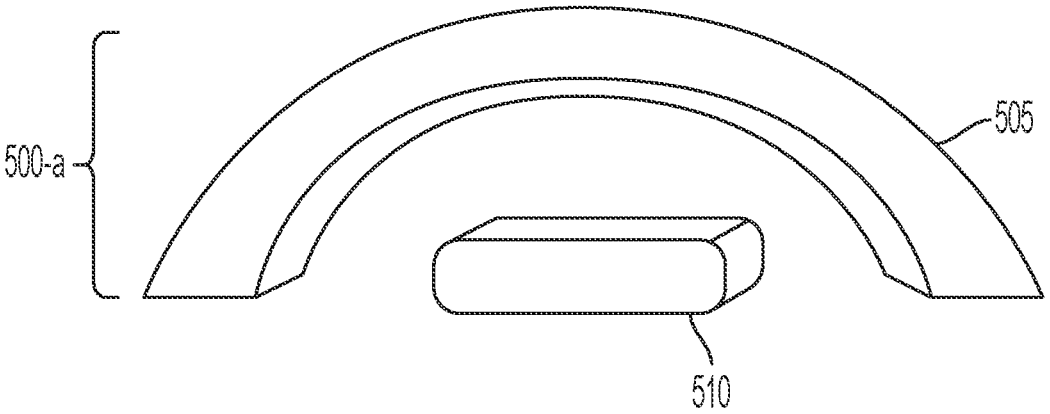
FIGS. 5A and 5B illustrate alternative impact shield system designs according to one or more embodiments of the present disclosure.

In some embodiments, the impact shield may include a canopy, a column, and a fitting. The canopy and column may be inflated via the fitting to provide protection from axial, and in some cases lateral, impacts (e.g., from falling objects or structures) in an earthquake. In some cases, the fitting is attached to the column, while in other cases the fitting is attached to the canopy. In some embodiments, the impact shield may include individual spars, such as individual spar 315 as depicted in FIG. 3. In still other embodiments, the impact shield may include an attachable mat or bed, such as bed 510 as depicted in FIG. 5A.

Inflatable Canopy

Figure 2A:
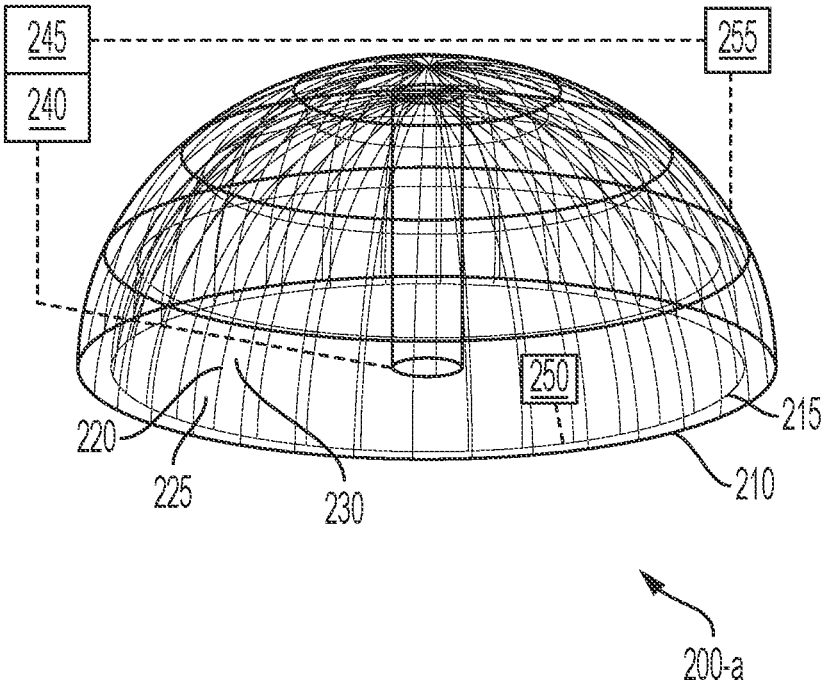
FIGS. 2A and 2B illustrate three-dimensional perspectives of an impact shield system according to one or more embodiments of the present disclosure.
Figure 2B:
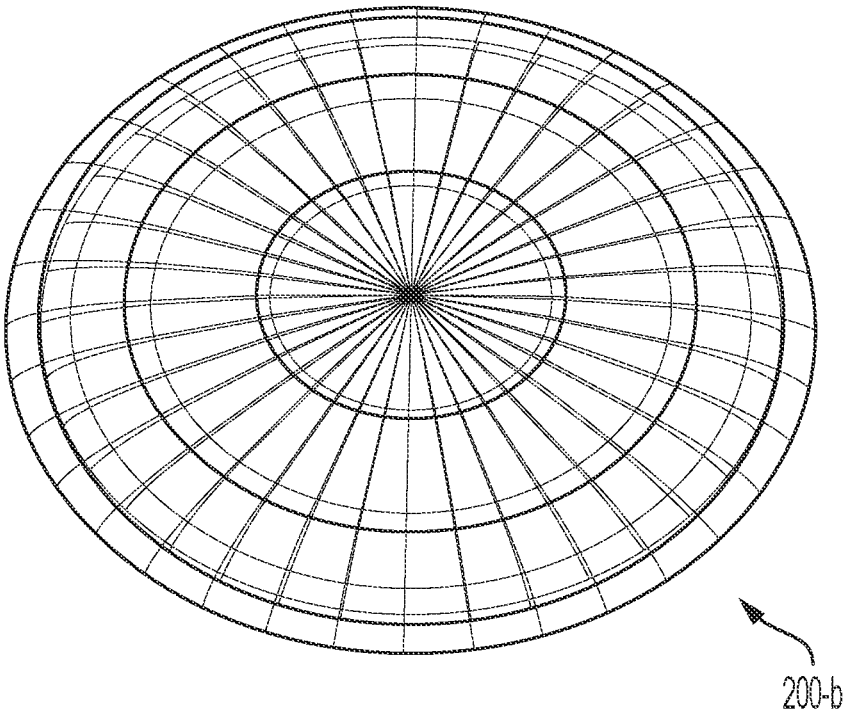

The system may include a canopy, which may cover and protect an individual underneath the impact shield. As seen in FIG. 2A, the canopy seen in perspective 200-*a* may include two separate walls, an outer wall 215 and an inner wall 210. The space between the outer wall 215 and the inner wall 210 may be filled with a gas (e.g., an inert gas) to provide structure to the system. When inflated, an individual may be able to climb underneath the impact shield and be protected from objects falling from above (e.g., structural collapse due to an earthquake).

A canopy of the impact shield may be designed in various different shapes to protect any individuals underneath. In some cases, the canopy may be designed in a domed shape, such as canopies shown in FIGS. 1-4. In these cases, the canopy may form a space designed in a semispherical fashion for an individual to shelter from falling objects. This domed design may provide protection not only from above, but from the sides as well.

Figure 5B:
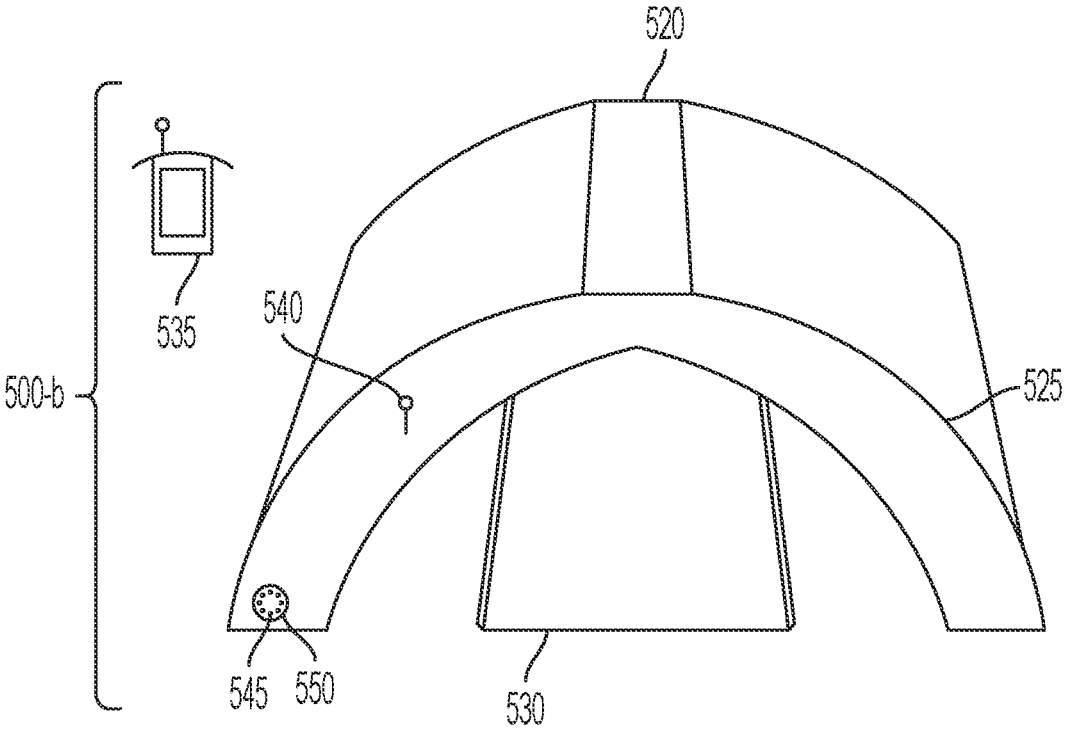

In other cases, the canopy may be designed in a "tunnel" or "bridge" shape, where at least one side of the impact shield remains open to the environment. The canopy may inflate to form an arch design, such as the canopies of impact shield designs 500-*a* and 500-*b* in FIGS. 5A and 5B, respectively. In these figures, the canopy 505 may be in the form of an archway, where the canopy 505 provides protection from the axial position (e.g., from above) as well as from two lateral sides. However, canopy 505 also maintains lateral openings to the environment, which may allow for easier access for individuals to enter the impact shield during a crisis. Similarly, canopy 525 is designed in the shape of a "flat top arch." This type of design is similar to the traditional archway design of the canopy 505, however the canopy 525 may include a flat portion 520 along the top of the canopy 525.

Spar Segments

Additionally, the impact shield may include individual spar segments to provide structural rigidity to the system. In some cases, the individual spar segments may create the canopy of the impact shield. For example, in FIGS. 2A and 2B, partition 220 may indicate a division between individual vertical spar 225 and individual vertical spar 230, where the individual vertical spars 225 and 230 may be located between inner wall 215 and outer wall 210. Thus, the structure and shape of the canopy shown in perspective 200-*a* is formed by the aggregation of the individual spars in FIGS. 2A and 2B.

Additionally or alternatively, the individual spar segments may be in addition to the canopy of the impact system. For example, in FIG. 3, impact shield 305 includes vertical spar segments 315 and 325. The vertical spar segments 315 and 325 may be located external to an outer wall of canopy, external to the inner wall of canopy 305, or a combination thereof. The vertical spar segments 315 and 325 may be attached to the inner wall and/or the outer wall by some form of attachment mechanism (e.g., stitching, a mesh fabric, fusion, etc.). In this scenario, the vertical spar segments 315 and 325 may provide additional protective support for the canopy 305 and/or may assist in forming the shape of the canopy 305.

In some cases, different spar segments may be perpendicular or parallel to other spar segments. FIG. 3 further provides examples of parallel and perpendicular spar segments. For example, vertical spar segment 315 may be parallel to vertical spar segment 325. In another example, horizontal spar segment 320 may be perpendicular to vertical spar segment 310. Parallel spar segment may assist in maintaining the shape of the impact shield canopy, whereas perpendicular spar segments may enhance the structural rigidity of the impact shield canopy.

Inflatable Column

The impact shield may additionally include a structural column when inflated. The structural column may provide support for the canopy by supporting any potential axial load the canopy may experience. The column may, therefore, significantly increases the structural rigidity of the system, and significantly increases the protection an individual may experience under the canopy during a building collapse.

An example is provided in FIG. 1. Column 115 may include wall 135. When inflated, wall 135 may become rigid, thereby forming column 115. Column 115 may be circular in shape. Alternatively, column 115 may be shaped in any shape which provides the structural properties of a column, such as a square column, a rectangular column, an octagonal column, a hexagonal column, an, n-gon column, etc.

An opening through the column 115 may allow for access to the canopy of the inflatable shield. For example, the column 115 in FIG. 1 may include an opening 120. The opening 120 allow for gas to access the canopy via the column 115. In this example, the column 115 may be inflated first, and then the canopy 110 may be inflated by gases flowing through the column 115 to the canopy 110. Alternatively, the opening 125 may be used for gases to enter the column 115 through the canopy 110. In this case, the canopy 110 may be inflated prior to the column 115, whereas the column 115 may be inflated by gases flowing from the canopy 110 into the column 115.

In some cases, the column 115 may include at least one individual spar segment. Additionally or alternatively, the column 115 may include a plurality of individual spar segments. Additionally or alternatively, the spar segments may run along the axial line or the lateral line. In some cases, the individual spar segments may run parallel to each other or may be perpendicular to one another.

Series and Parallel Spar Connections

The spar segments may be connected in both series and parallel connections. Each spar segment may include a set of one-way valves. Each one-way valve may allow for gas to flow a specific direction within the individual spar segment. The one-way valves may be configured to allow for gas to flow from one individual spar segment into another individual spar segment. The impact shield may be inflated by inflating an individual spar segment that is configured with one-way valves. The one-way valves may allow for gas to pass into the individual spar segment in one direction. The gas may flow from the individual spar segment and through a one-way valve into another individual spar segment. This process may continue until the entire impact shield is inflated.

Figure 4:
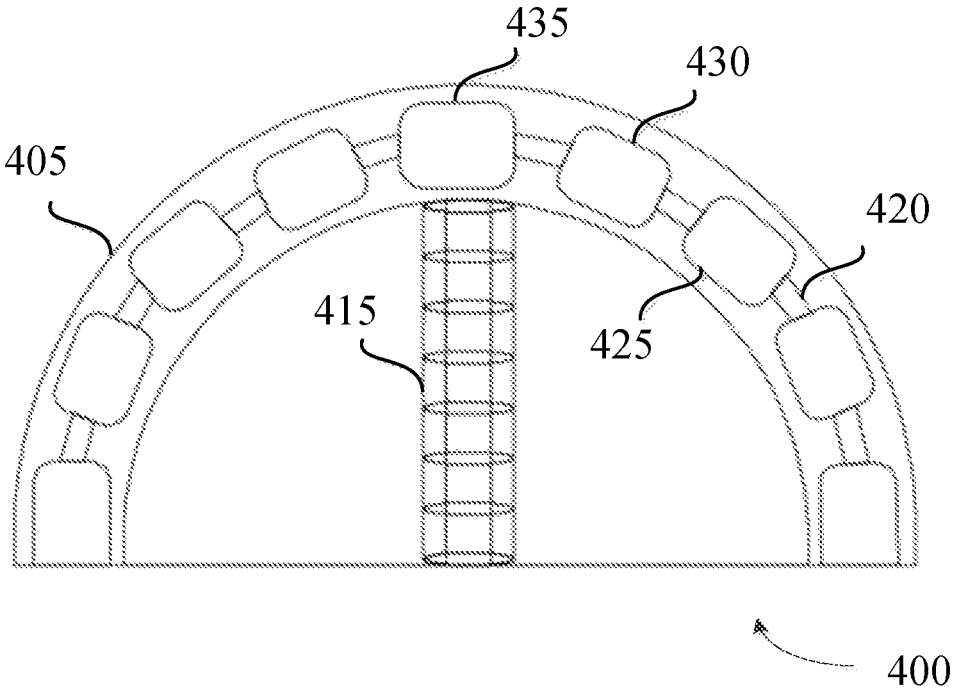
FIG. 4 illustrates a cross-sectional view of an impact shield system according to one or more embodiments of the present disclosure.

The one-way valves may protect against the individual spar segments from deflating in case of a leak or puncture experienced by the impact shield. For example, FIG. 4 depicts a cross-section view 400 of an embodiment of the inflatable shield. The individual spar segments (e.g., spar segments 425, 430, and 435) may be connected to one another via one-way valves. During inflation, spar segment 435 may receive gas from the column 415 via a one-way valve. As the spar segment 435 inflates, gas from spar segment 435 may pass through a one-way valve connected to spar segment 430. Subsequently, spar segment 430 may inflate from gas passed from spar segment 435. This process may continue until all spar segments of impact shield 405 are inflated. However, in the case that a spar segment (e.g., spar segment 430) is punctured or deflated, the one-way valves prevent the other spar segments (e.g., neighboring spar segment 425) from transferring gas to the punctured/deflated spar segment, thereby preventing the deflation of other spar segments and maintaining the structural integrity of the impact shield. Thus, the system can utilize a series connection between the spar segments in that spar segments inflate directly from gas transferred from connected spar segments. Yet the system can utilize parallel connections between the spar segments in that a deflation of one spar segment does not compromise the structural integrity of other connected spar segments.

Inflation Process

Initiation of inflating the impact shield may be performed either automatically or manually. For automatic inflation, the impact shield may be connected, either wirelessly or physically, to a seismic activity device. The seismic activity device may detect seismic activity occurring, and may initiate the inflation of the impact shield in the event that seismic activity occurs. In some cases, the seismic activity device may include a smartphone, such as smartphone 535. The smartphone may detect seismic activity by receiving a notification from an external source, such as a disaster alert from a government department or weather website, or the like. The smartphone may wirelessly communicate with a transceiver joined to the impact shield.

Additionally or alternatively an application running on the smartphone may receive the notification, may be wirelessly paired with the transceiver, or a combination thereof. The wireless communication may include an instruction to inflate the impact shield based on the detected seismic activity. Additionally or alternatively, the impact shield may be inflated via the pulling of a rip cord or the pushing of a manual button.

The impact shield may be inflated via a compressed gas. The fitting of the impact shield (e.g., fitting 545) may be attached to a canister, such as canister 550. The canister may include a chemical explosive, such as sodium azide and other chemicals such in automotive air bags or aircraft slides, that when triggered, may fill the volume of the canopy in a short period of time with a gas generated through a chemical reaction. The amount of the chemical explosive may be limited to provide an adequate amount of inert gas to fill the canopy. Additionally or alternatively, the canopy may include at least one pressure release valve, which may release excess pressure within the canopy to avoid compromising the structural integrity of the impact shield. In some embodiments, the canopy components can be "leaky" (e.g., at the fabric and/or stitching) to allow for the slow release of gas.

Attachable Mat or Bed

In some cases, the impact shield may additionally include an attachable mat or bed. The impact shield may be designed to allow the mat or bed to fit under the canopy, such as bed 510 and mat 530. Individuals may lay down on or sit on the mat or bed (e.g., individuals 130 and 330). The mat or bed may include a set of eyelets or straps on different sides that may correspond to latches or hooks attached to the canopy. Thus, the mat or bed may be secured to the canopy of the impact shield, which may provide for additional protection and additional rigidity to the system.

The floor of the impact shield need not be inflatable, but can provide further rigidity by preventing the sidewalls from spreading.

Emergency Response Device

The impact shield may also include an emergency response device. The emergency response device may automatically transmit a distress signal upon inflation of the impact shield. The distress signal may include information corresponding to the location of the emergency response device, and thus the location of the inflated impact shield, providing emergency responders the location of trapped individuals in the case of an earthquake or building collapse. In some cases, the emergency response device may additionally be incorporated with the transceiver of the impact shield discussed above with reference to the seismic activity device (e.g., transceiver 540).

Exemplary Dimensions

The impact shield may be designed with varying dimensions, based on the desired benefits. For example, the impact shield may be designed with an attachable mat or bed as discussed above. In this example, the impact shield may be designed to cover a surface area relatively equal to the surface area of a corresponding mat or bed (e.g., a twin bed size, a double bed size, a queen bed size, a king bed size, etc.). Furthermore, the impact shield dimensions may vary according to the number of occupants are intended to be protected. For example, in FIGS. 1 and 3, impact shields 100 and 300 are shown covering individuals 130 and 330, respectively, and may be designed with dimensions intended for protection of single individuals. However, impact shields 100 and 300 may be designed differently with dimensions to cover multiple people after inflation.

Exemplary Materials

The components described herein can be fabricated from a variety materials. The materials can be in a variety of forms such as sheet (e.g., extruded), textile, fabric, and the like.

Exemplary materials include, but are not limited to: natural fibers, cotton, wool, silk, hemp, flax, animal hair, jute, modal, cellulose, bamboo, piña, ramie, nettles, milkweed, seaweed, metals, manufactured fibers, azlon, acetate, triacetate, viscose, lyocell, glass, graphite carbon, carbon fiber, carbon nanotube, liquid crystal, ceramics, polyesters, aramids, para-aramids, meta-aramids, aromatic polyesters, rayon, acrylics, modacrylics, polyacrylonitrile, polylactides (PLAs), polyamides, polyamide 6, polyamide 6.6, rubber lastrile, lastol, polyethylene (PE), high-density polyethylene (HDPE), polyethylene terephthalate (PET), polypropylene (PP), polytetrafluoroethylene (PTFE), vinyl, vinyon, vinylidene chloride, polyvinylidene chloride (PVDC), polybenzimidazole (PBI), novoloid, melamine, anidex, nytril, elastoester, nylon, spandex/elastane, olefins, biosynthetic polymers, and blends of the same.

Materials can be engineered to provide desired attributes such as resistance to radiation (e.g., ultraviolet and/or cosmic), puncture, temperatures, humidity, and the like.

EQUIVALENTS

Although preferred embodiments of the invention have been described using specific terms, such description is for illustrative purposes only, and it is to be understood that changes and variations may be made without departing from the spirit or scope of the following claims.

Incorporation by Reference

The entire contents of all patents, published patent applications, and other references cited herein are hereby expressly incorporated herein in their entireties by reference.

The invention claimed is:

1. An impact shield, comprising:

a canopy constructed of a puncture-resistant material, the canopy defining a first internal volume accessible via a first opening, the internal volume being partially defined by an outer wall and an inner wall, the canopy being structured to form a semispherical shape when in an inflated state, the semispherical shape defining a space dimensioned for sheltering at least one human body, the canopy comprising a plurality of individual spars, the plurality of individual spars being attached to a portion of the canopy;

a support joined to the canopy and constructed of the puncture-resistant material, the support defining a second internal volume accessible via the first opening and a second opening, the support located within the space, the support structured to form a column when in the inflated state;

and a fitting joined to the support for closing the second opening to fix the first internal volume and the second internal volume after inflation of the support and the canopy.

2. The impact shield of claim 1, wherein at least one of the plurality of individual spars extends perpendicular to at least a second of the plurality of individual spars.

3. The impact shield of claim 1, wherein at least one of the plurality of individual spars extends parallel to at least a second of the plurality of individual spars.

4. The impact shield of claim 1, wherein the plurality of individual spars are connected in a series configuration, in a parallel configuration, or a combination thereof.

5. The impact shield of claim 4, wherein the series configuration, the parallel configuration, or the combination thereof, prevents a deflation of the canopy when at least one of the plurality of individual spars is punctured.

6. The impact shield of claim 1, wherein the support further comprises at least one individual spar.

7. The impact shield of claim 1, further comprising:

an inflation mechanism joined to the fitting, the inflation mechanism configured to, when activated, direct a flow of gas into the support to cause the support and the canopy to assume the inflated state.

8. The impact shield of claim 7, wherein the impact shield is configured to be connected to a seismic activity device, the seismic activity device configured to:

identify a seismic event and activate the inflation mechanism when the seismic event is identified.

9. The impact shield of claim 8, wherein the seismic detection device comprises a smartphone.

10. The impact shield of claim 1, further comprising a mat or bed, the mat or bed attachable to a bottom portion of the canopy.

* * * * *